US010716347B2

(12) United States Patent
Dashefsky

(10) Patent No.: US 10,716,347 B2
(45) Date of Patent: Jul. 21, 2020

(54) KNOT HOLDER

(71) Applicant: Daynin J. Dashefsky, Honolulu, HI (US)

(72) Inventor: Daynin J. Dashefsky, Honolulu, HI (US)

( * ) Notice: Subject to any disclaimer, the term of this patent is extended or adjusted under 35 U.S.C. 154(b) by 351 days.

(21) Appl. No.: 15/688,693

(22) Filed: Aug. 28, 2017

(65) Prior Publication Data

US 2019/0059485 A1 Feb. 28, 2019

(51) Int. Cl.
*A41F 9/00* (2006.01)
*A41F 1/00* (2006.01)

(52) U.S. Cl.
CPC ..... *A41F 9/002* (2013.01); *A41F 1/00* (2013.01); *A41D 2300/33* (2013.01); *A41D 2600/10* (2013.01)

(58) Field of Classification Search
CPC ..... A41F 9/002; A41F 1/00; A41D 2600/10; A41D 2300/33
See application file for complete search history.

(56) References Cited

U.S. PATENT DOCUMENTS 722,891 A * 3/1903 Pitman ..... A43C 7/00 24/712.2
915,176 A * 3/1909 Hicks ..... A43C 7/00 24/712.2
960,013 A * 5/1910 Highfield ..... A41F 11/02 24/327
2,139,959 A * 12/1938 Knoyle ..... A41D 25/022 2/150
2,635,248 A * 4/1953 Wester ..... A41D 25/14 2/153
5,539,933 A 7/1996 Garber et al.
5,624,296 A * 4/1997 Weber-Unger ..... A41C 3/04 2/101
6,253,424 B1 * 7/2001 Rainville-Lonn ..... A41C 3/02 24/306
D453,413 S * 2/2002 Tsujino ..... D2/978
6,449,774 B1 9/2002 Michael
6,532,600 B2 3/2003 Brignoli
6,601,323 B2 * 8/2003 Tsujino ..... A43C 7/02 24/712.3
6,996,855 B1 2/2006 Dandrea
7,086,925 B2 * 8/2006 Kaye ..... A41C 3/12 2/267
8,752,309 B2 * 6/2014 Cashel ..... A43B 1/0081 36/136
9,468,262 B2 * 10/2016 Caron ..... A43C 7/005

* cited by examiner

*Primary Examiner* — Robert Sandy
*Assistant Examiner* — Louis A Mercado
(74) *Attorney, Agent, or Firm* — Kunzler Bean & Adamson

(57) ABSTRACT

Two apparatuses and a method are disclosed. The first apparatus includes a retention surface that substantially surrounds a knot; and a retention mechanism that couples a first end of the retention surface to a second end of the retention surface. The second apparatus includes a first retention surface; a second retention surface; a retention mechanism; and a tightening mechanism. The method includes providing a knot holder that includes a retention surface, a retention mechanism and a tightening mechanism; placing the knot holder around a knot, fastening a first end of the retention surface to a second end of the retention surface; and tightening the knot holder against the knot with the tightening mechanism.

19 Claims, 13 Drawing Sheets

KNOT HOLDER

FIELD

This invention relates to knot retention and more particularly relates to passive prevention of loosening or untying of knots.

BACKGROUND

Despite being used throughout history, knots are still useful in the modern day. However, these knots can come undone at the most inopportune times and must be re-tied, wasting time and energy. One example where this is a problem is the field of martial arts. Frequently, martial artists must stop and re-tie their belts in the middle of practice, lessons and even tournaments. Such interruptions make practice, lessons and tournaments inefficient, and, especially in the case of tournaments, unfair due to abuse. Some competitors will take advantage of the belts coming undone in order to rest in the middle of a fight, which is normally not allowed. Others have even purposefully tied their belts loosely in order to assure that the belts will come undone and offer an unfair rest period.

Previous solutions are primitive, often involving a last-minute application of tape to keep the knot from coming undone. Though useful in many areas, tape is not ideal for martial arts belts or other applications utilizing knots because of the conflicting aesthetics and the difficulty of application and removal. Use of tape in such a situation goes against the point of using knots: a strong, yet removable (and reusable) connection. Others have tried a martial arts belt with an integrated knot holder. However, this again runs into the problems of aesthetics as it does not offer the option of easily switching to a traditional aesthetic; one must completely change out a belt. A more elegant solution and functional solution is needed.

Other areas of use have comparably problematic situations for which an elegant solution is required.

SUMMARY

Two variations of an apparatus and a method are disclosed.

The first apparatus includes a retention surface that substantially surrounds a knot; and a retention mechanism that couples a first end of the retention surface to a second end of the retention surface.

The second apparatus includes a first retention surface; a second retention surface; a retention mechanism that couples the first retention surface to the second retention surface; and a tightening mechanism coupled to the first retention surface and the second retention surface.

The method includes providing a knot holder that comprises: a retention surface, a retention mechanism that fastens a first end of the retention surface to a second end of the retention surface, and a tightening mechanism that tightens the retention surface against the knot; placing the knot holder around a knot; fastening the first end of the retention surface to the second end of the retention surface with retention mechanism of the knot holder; and tightening the knot holder against the knot with the tightening mechanism of the knot holder.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided. One skilled in the relevant art will recognize, however, that the invention may be practiced without one or more of the specific details, or with other methods, components, materials, and so forth. In other instances, well-known structures, materials, or operations may not be shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
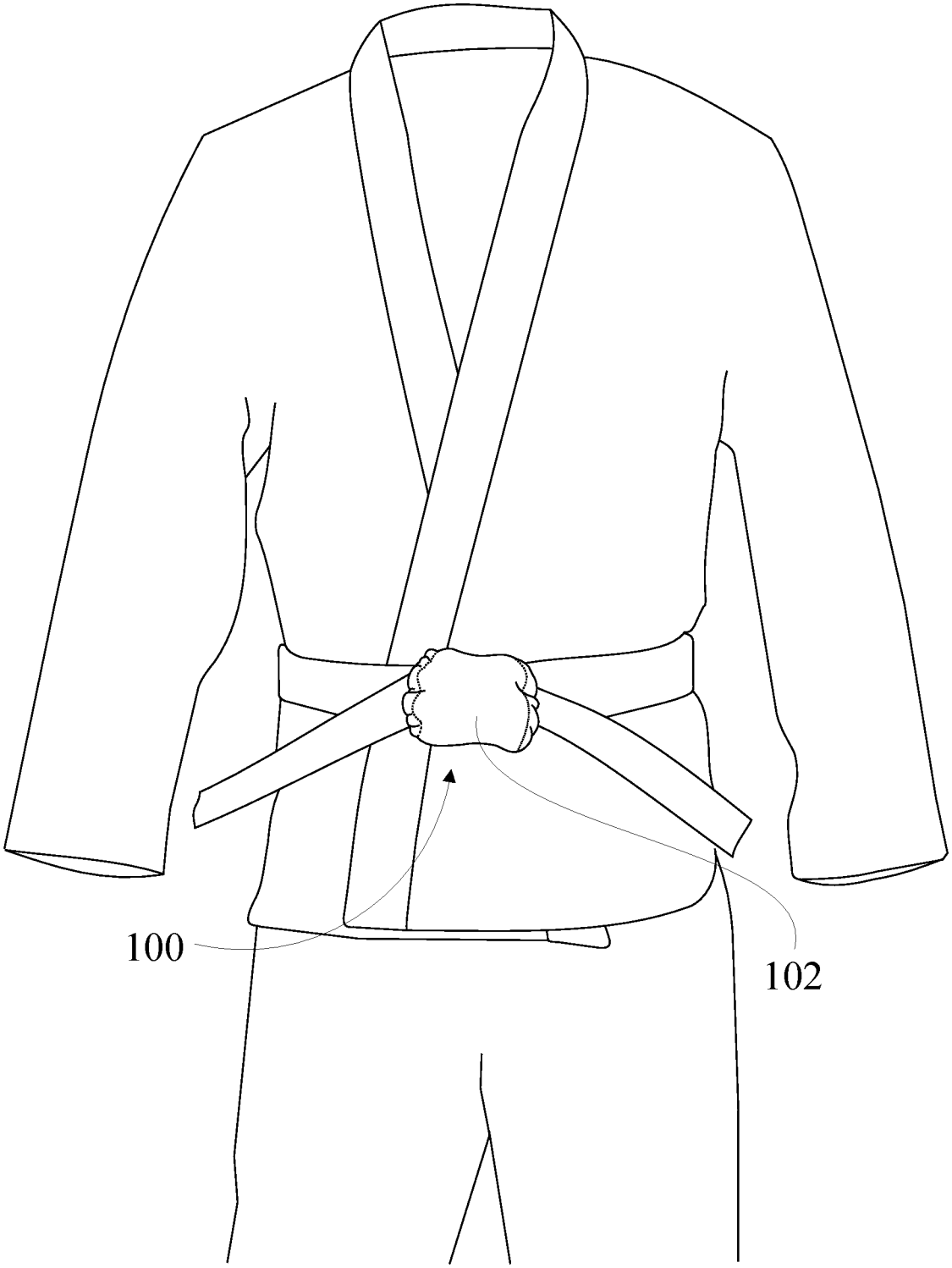
FIG. 1 is a front perspective view illustrating one embodiment of a knot holder.

FIG. 1 depicts a front perspective view of one embodiment of a knot holder.

The apparatus 100, in some embodiments, is designed to hold a knot in place and prevent it from becoming untied. Such an apparatus has multiple uses in many different areas. One important area of use involves martial arts, and retention of the knots made in martial arts belts. Though many examples provided herein will involve martial arts belts, the embodiments are not limited to use in martial arts, and may be used in a variety of applications, such as boating, camping, crafts, spelunking, rescue operations, climbing, ropework or other applications wherein additional retention of a knot is required. Furthermore, the embodiments are not limited to tying of belts or rope; knots tied into any material will benefit from use of the apparatus 100.

In some embodiments, and as depicted in FIG. 1, the apparatus 100 is placed around a knot in a martial arts belt. The apparatus 100 helps to keep the knot tied tightly, so that it does not loosen, fall of, or otherwise interfere with the martial arts training or competition.

The apparatus 100 is sized as to be adaptable to a variety of different knots. For example, martial arts belts come in different sizes for children and for adults. Furthermore, different types of knots may be used with the same size of belt, which may vary the size and exact configuration of the knot. The apparatus 100, in some embodiments, is designed to accommodate these various types and sizes of knots.

In some embodiments, the apparatus 100 comprises a retention surface 102 that helps to keep the knot tied tightly. In different embodiments, the retention surface 102 may comprise a variety of different materials, including cotton, nylon, polyester or other materials. In some embodiments, the retention surface 102 may be made of a material that allows silk screening or other methods of printing, drawing, or marking the material such that a logo, picture, or words may be placed on the material.

In some embodiments, the retention surface 102 may comprise a material that is stretchable, such as spandex, an elastane material, or another stretchable material. By using a stretchable material in the retention surface 102, the apparatus 100 is better able to adapt to different types and sizes of knots by conforming to the shape of the individual knot while avoiding extra, hanging material if the apparatus 100 is used on a smaller knot.

In some embodiments, the apparatus 100 is sized to fit around a martial arts belt knot. In other embodiments, the apparatus 100 is sized to fit larger knots, and in yet other embodiments, the apparatus 100 is sized to fit smaller knots. Because the apparatus 100 may be used in a variety of different cases, the particular dimensions of the apparatus 100 may vary between different embodiments.

Figure 2:
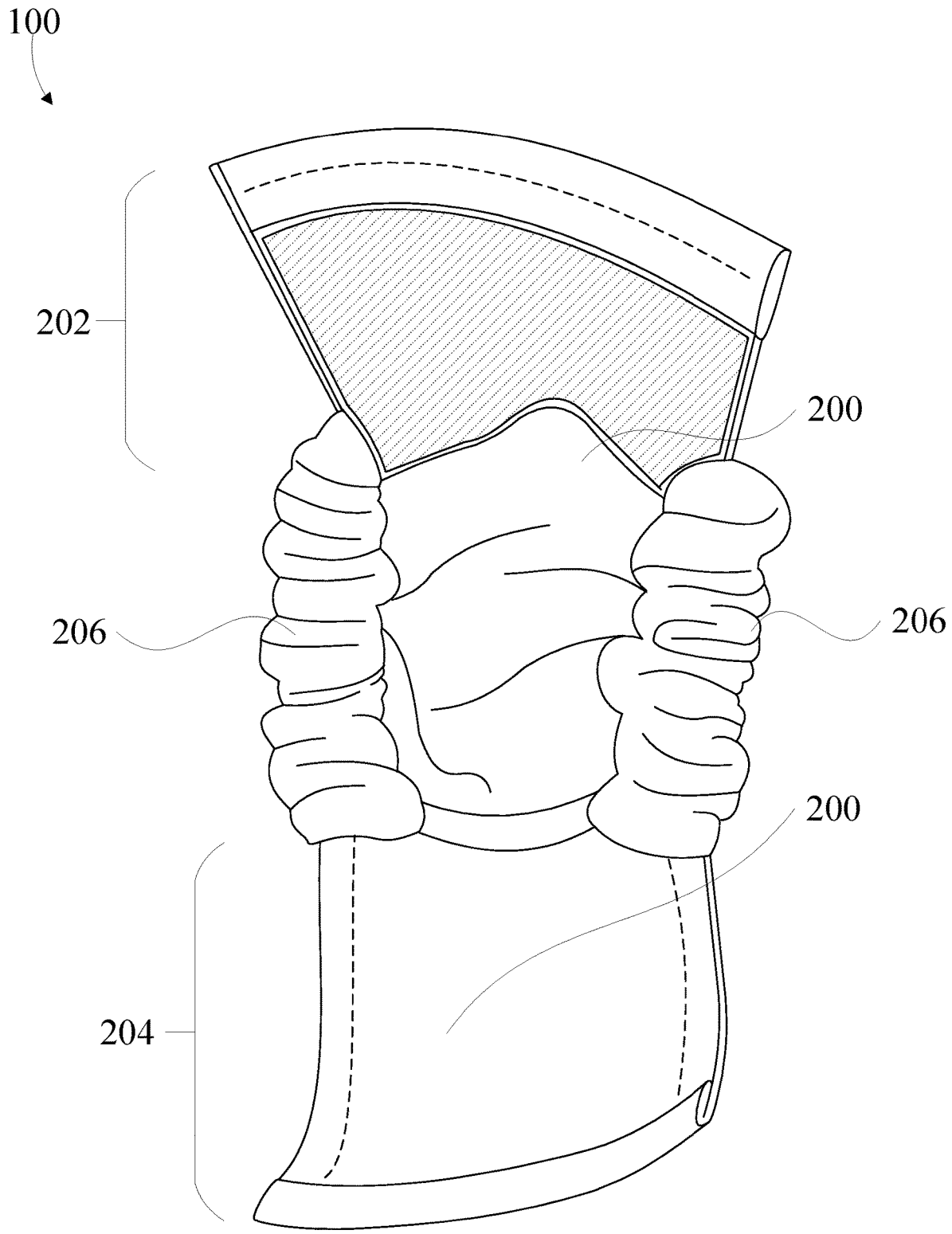
FIG. 2 is a back perspective view illustrating one embodiment of a knot holder.

FIG. 2 depicts a back perspective view of one embodiment of a knot holder in according with one embodiment.

In some embodiments, the retention surface 102 may include a liner 200. The liner 200 may comprise a variety of different materials, including cotton, nylon, polyester or other materials. In some embodiments, the liner 200 may be made of a material that allows silk screening or other methods of printing, drawing, or marking the material such that a logo, picture, words or other markings may be placed on the material. In some embodiments, the liner 200 may comprise a material that is stretchable, such as spandex or another stretchable material.

In some embodiments, the use of a liner 200 permits a different look to be obtained by reversing the apparatus 100. Some users may prefer a plain, understated look of solid colors or simple designs, where other users may opt for a flashier, more pronounced design. In other cases, a single user may prefer an understated look for some situations, and a flashier, eye-catching look for other situations. Use of a liner 200 in some embodiments accounts for all of these, as well as other possibilities, by allowing different colors, designs, logos, words or other markings to be used on one article while still allowing for flexibility in different situations.

In some embodiments, the retention surface 102 includes a first end 202 and a second end 204. In some embodiments, when the apparatus 100 is placed around a knot to secure it, the first end 202 of the retention surface 102 is coupled to the second end 204 of the retention surface 102. This coupling may be achieved by a variety of different methods, which will be discussed herein.

In some embodiments, the first end 202 of the retention surface 102 and the second end 204 of the retention surface 102 are tapered such that a middle portion of the retention surface 102 is wider than the first end 202 and second end 204 of the retention surface 102. In some embodiments, the first end 202 and second end 204 of the retention surface 102 are not tapered, but the width of both the first end 202 and second end 204 is less than the width of a middle portion of the retention surface 102. Whether the first end 202 and second end 204 of the retention surface 102 are tapered or whether they are narrower than a middle portion of the retention surface 102, the purpose is the same: to reduce the amount of material that surround the knot while at the same time providing enough material for adequate retention of the knot. Such reduction of material is desirable to reduce production costs, but it is also desirable in embodiments where the apparatus 100 is to be worn by a user (such as some of the provided examples wherein the apparatus 100 retains a knot in a martial arts belt worn by the user), which provides increased comfort.

In some embodiments, the apparatus 100 includes at least one gusset 206 that is coupled to the first end 202 and the second end 204 of the retention surface 102. The gussets 206 provide a variety of functions. In addition to providing a neat, clean look to the apparatus 100 by covering up any gaps that may occur between the apparatus 100 and the knot, the gussets 206 provide additional functionality by preventing the apparatus 100 from sliding off of the knot (while staying on the belt, rope or other material with which the knot is made) as well as providing additional retention of the knot and stopping it from becoming loose or untied.

In some embodiments, the gussets 206 comprise a non-flexible material. In other embodiments, the gussets 206 comprise a flexible material that will help secure the apparatus 100 and secure the knot, such as cotton, nylon, polyester or other materials. In some embodiments, the gusset 206 may comprise a material that is stretchable, such as spandex or another stretchable material. Such a material will provide additional retention of the knot, as well as further prevent the apparatus 100 from moving off of the knot.

Figure 3:
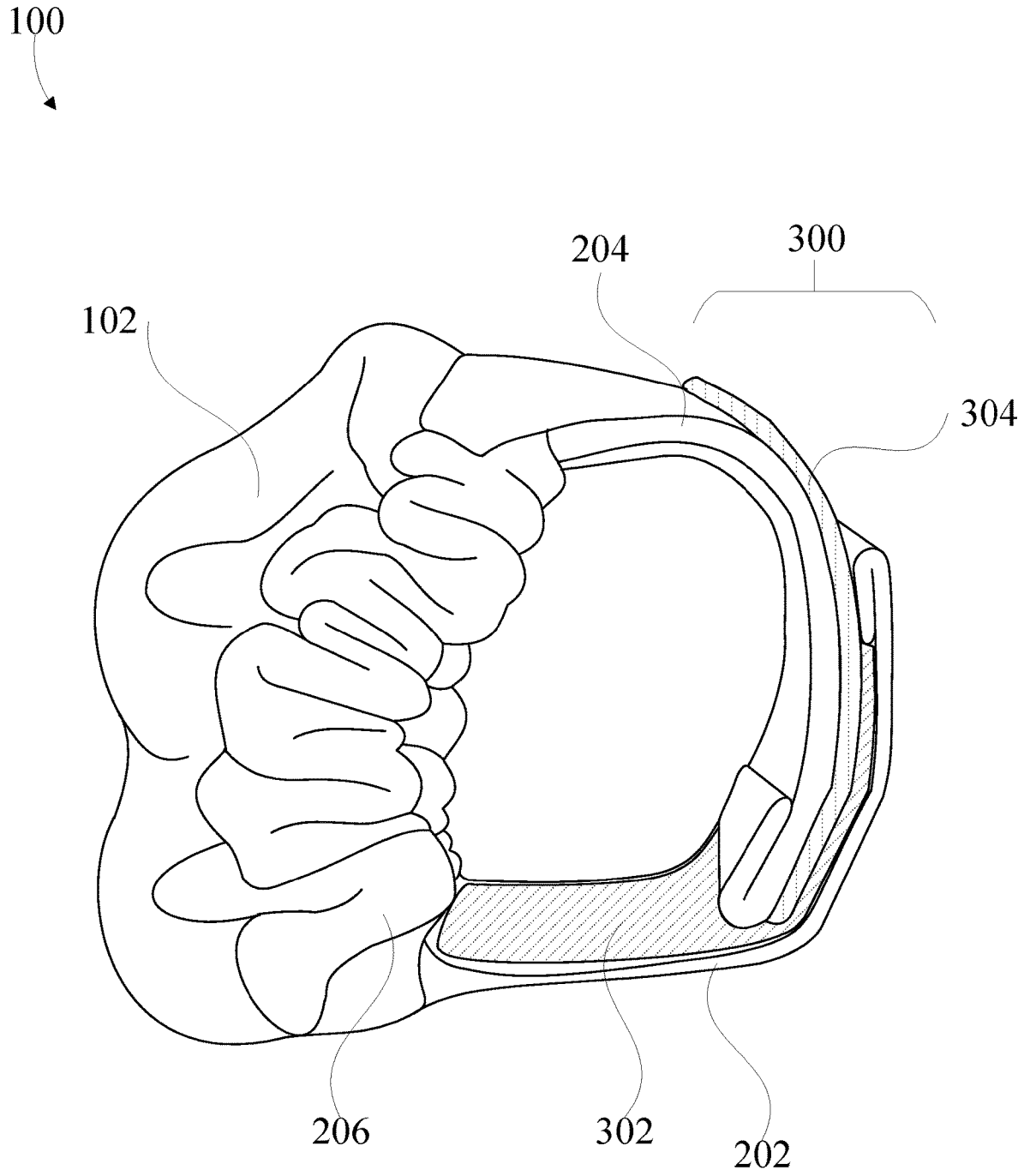
FIG. 3 is a side perspective view illustrating one embodiment of a knot holder.

FIG. 3 depicts a side perspective view of one embodiment of a knot holder.

In some embodiments, the apparatus 100 includes a retention mechanism 300. In some embodiments, the retention mechanism couples the first end 202 of the retention surface 102 to the second end 204 of the retention surface 102, thereby securing the apparatus 100 against the knot and preventing the knot from becoming loose or undone.

Figure 8:
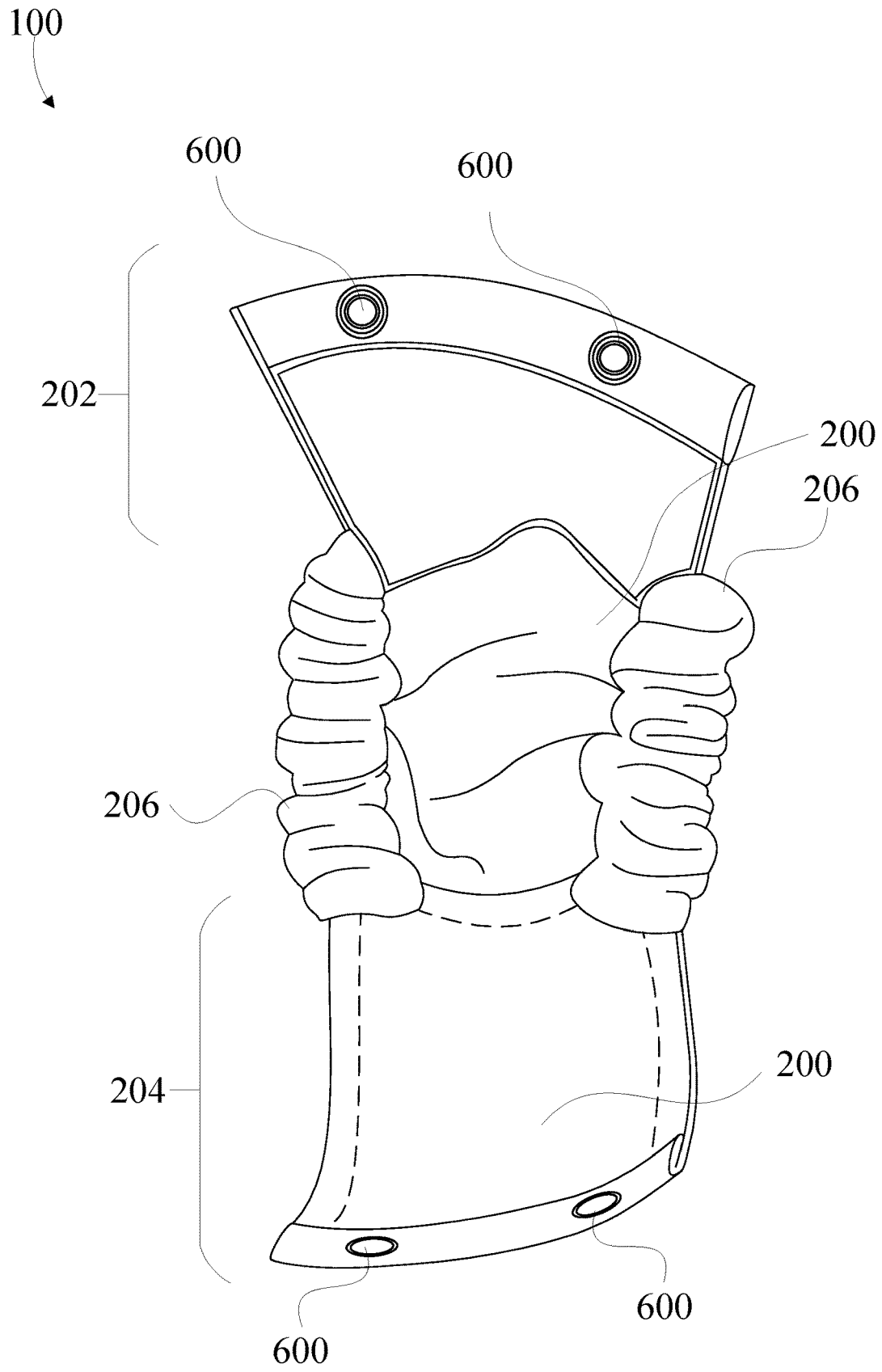
FIG. 8 is a back perspective view illustrating one embodiment of a knot holder.
Figure 9:
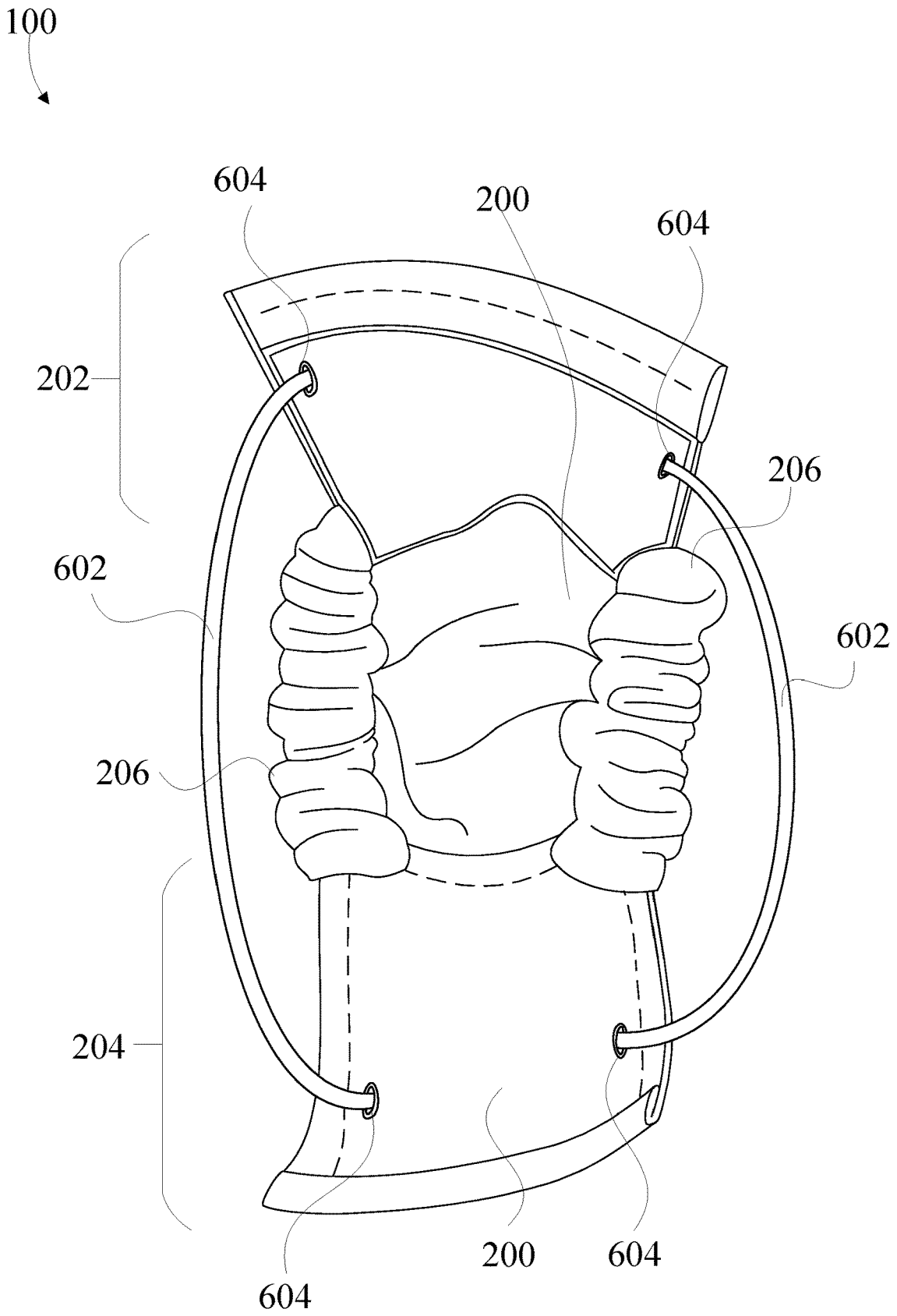
FIG. 9 is a back perspective view illustrating one embodiment of a knot holder.
Figure 10:
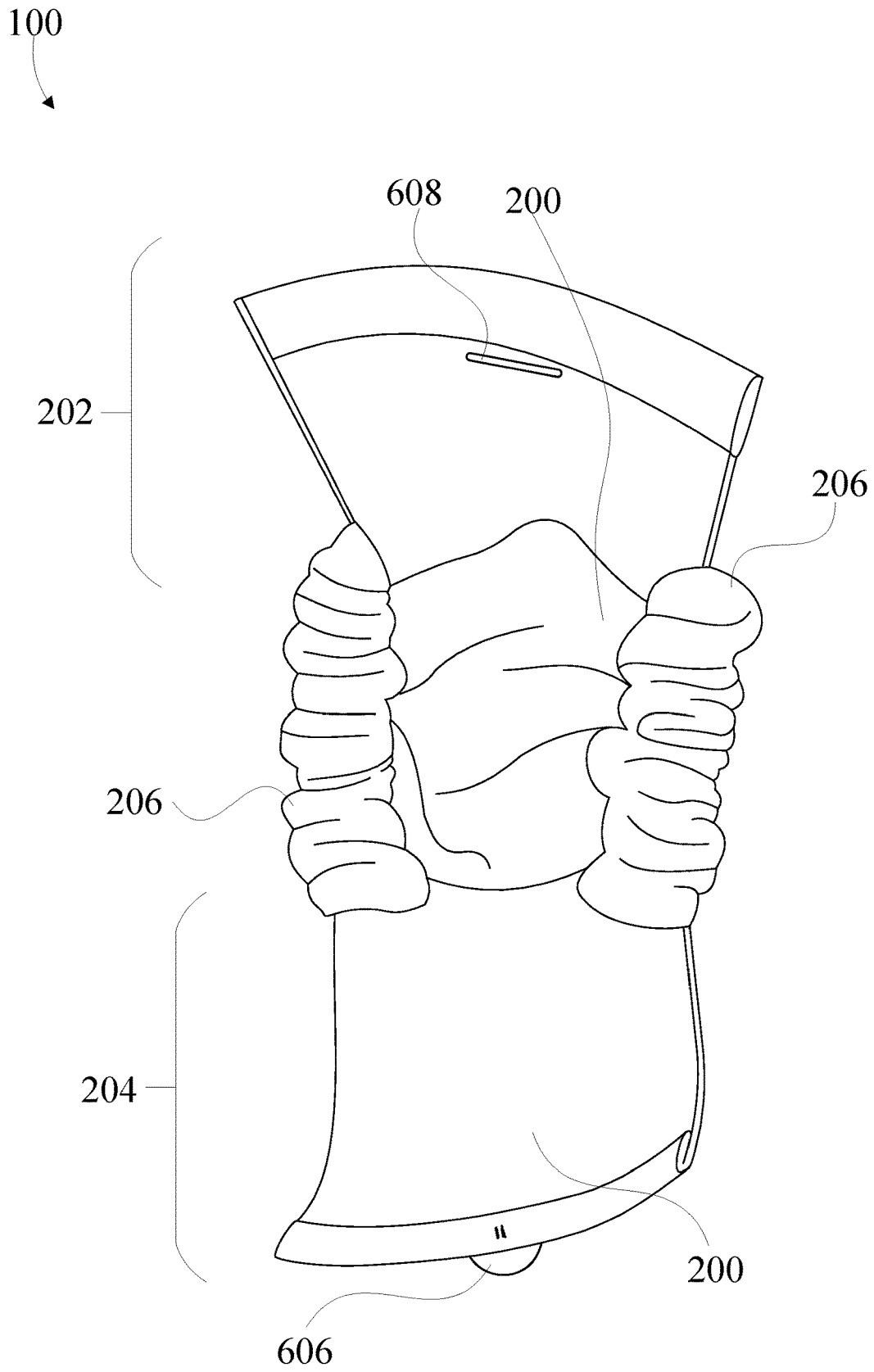
FIG. 10 is a back perspective view illustrating one embodiment of a knot holder.
Figure 11:
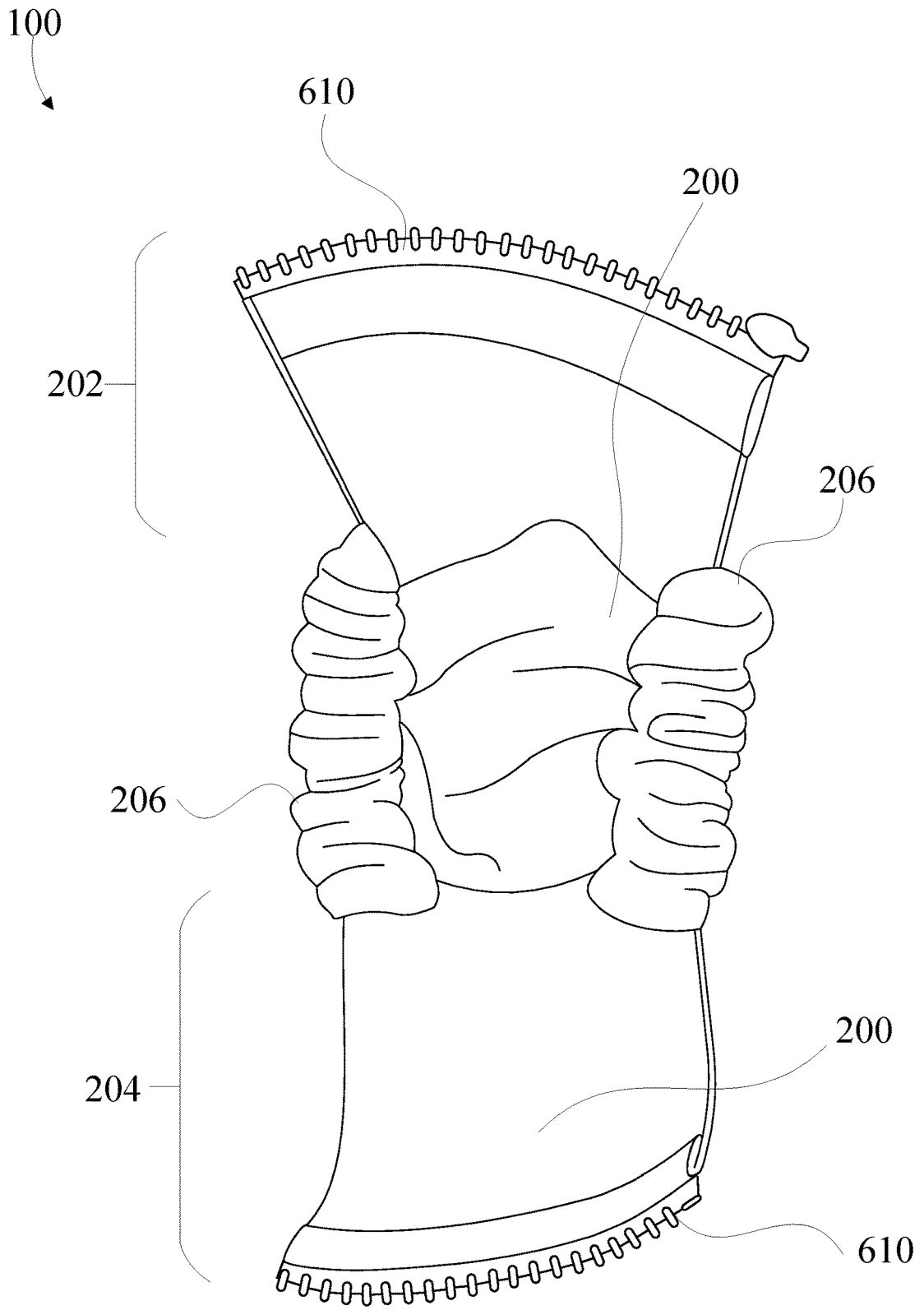
FIG. 11 is a back perspective view illustrating one embodiment of a knot holder.
Figure 12:
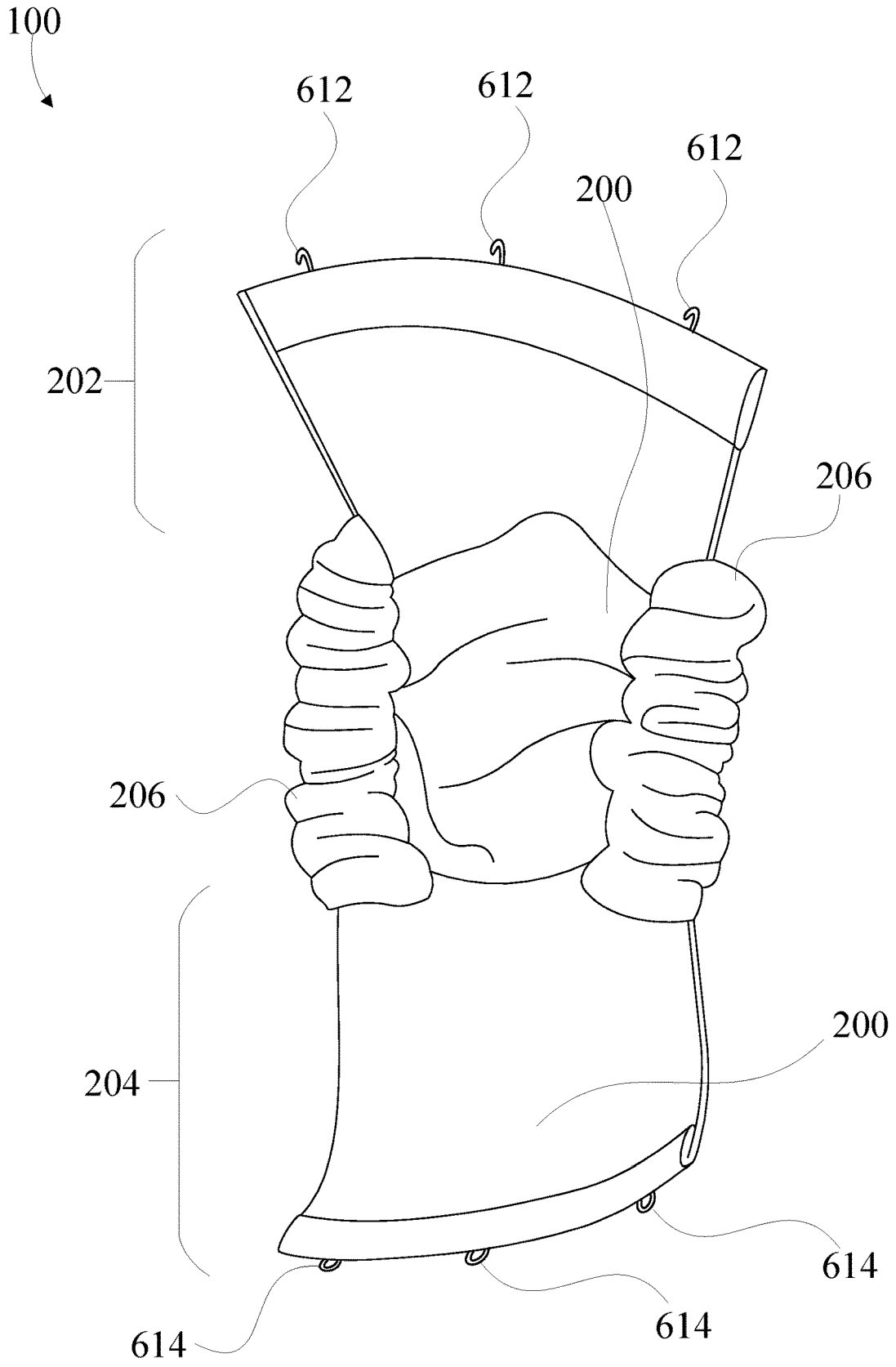
FIG. 12 is a back perspective view illustrating one embodiment of a knot holder.

The retention mechanism 300 may comprise a variety of different mechanisms for coupling known in the art, such as Velcro-type loop closures, zippers, buttons, snaps, string or cord woven through holes, hooks and eyelets, or other coupling methods. Various such examples are depicted in the Figures. FIG. 8 depicts snaps 600 used as the retention mechanism. FIG. 9 depicts a retention string 602 woven through holes 604 used as the retention mechanism. FIG. 10 depicts a button 606 and a buttonhole 608 used as the retention mechanism. FIG. 11 depicts a zipper 610 used as the retention mechanism. FIG. 12 depicts hooks 612 and eyelets 614 used as the retention mechanism. The embodiments are not limited to the specific examples provided herein.

In some embodiments, the retention mechanism 300 is configured such that the entire apparatus 100 may be flipped 180 degrees, such that the side of the retention surface 102 (or liner 200, in some embodiments) faces away from the knot, and the retention mechanism 300 is still capable of coupling the first end 202 of the retention surface 102 to the second end 204 of the retention surface 102. The exact method of coupling the first end 202 of the retention surface 102 to the second end 204 of the retention surface 102 will vary depending on the type of mechanism used for the retention mechanism 300. Certain variations on the type of mechanism or modifications to the retention mechanism 300 itself may be required to allow flipping of the apparatus 100, and will vary based on the specific retention mechanism 300 used.

In some embodiments, and as shown in FIG. 3, the retention mechanism 300 comprises a Velcro style closure. In this example, the hook material 302 of the Velcro style closure is coupled to the first end 202 of the retention surface 102, and the loop material 304 of the Velcro style closure is coupled to the second end 204 of the retention surface 102. Thus, the user simply places the apparatus 100 around the knot that should be kept tight, and secures the retention mechanism 300 to retain the apparatus with the desired amount of force against the knot.

In some embodiments, the retention mechanism 300 comprises a hook and eye closure, commonly used in the clothing industry. In such embodiments, a hook may be placed on the first end 202 of the retention surface 102, and the eye may be placed on the second end 204 of the retention surface 102. In some embodiments, the retention mechanism 300 may comprise multiple hooks or multiple eyes, so that the apparatus 100 can accommodate a variety of different knot sizes and types, as well as different amounts for retention for different situations.

Figure 4:
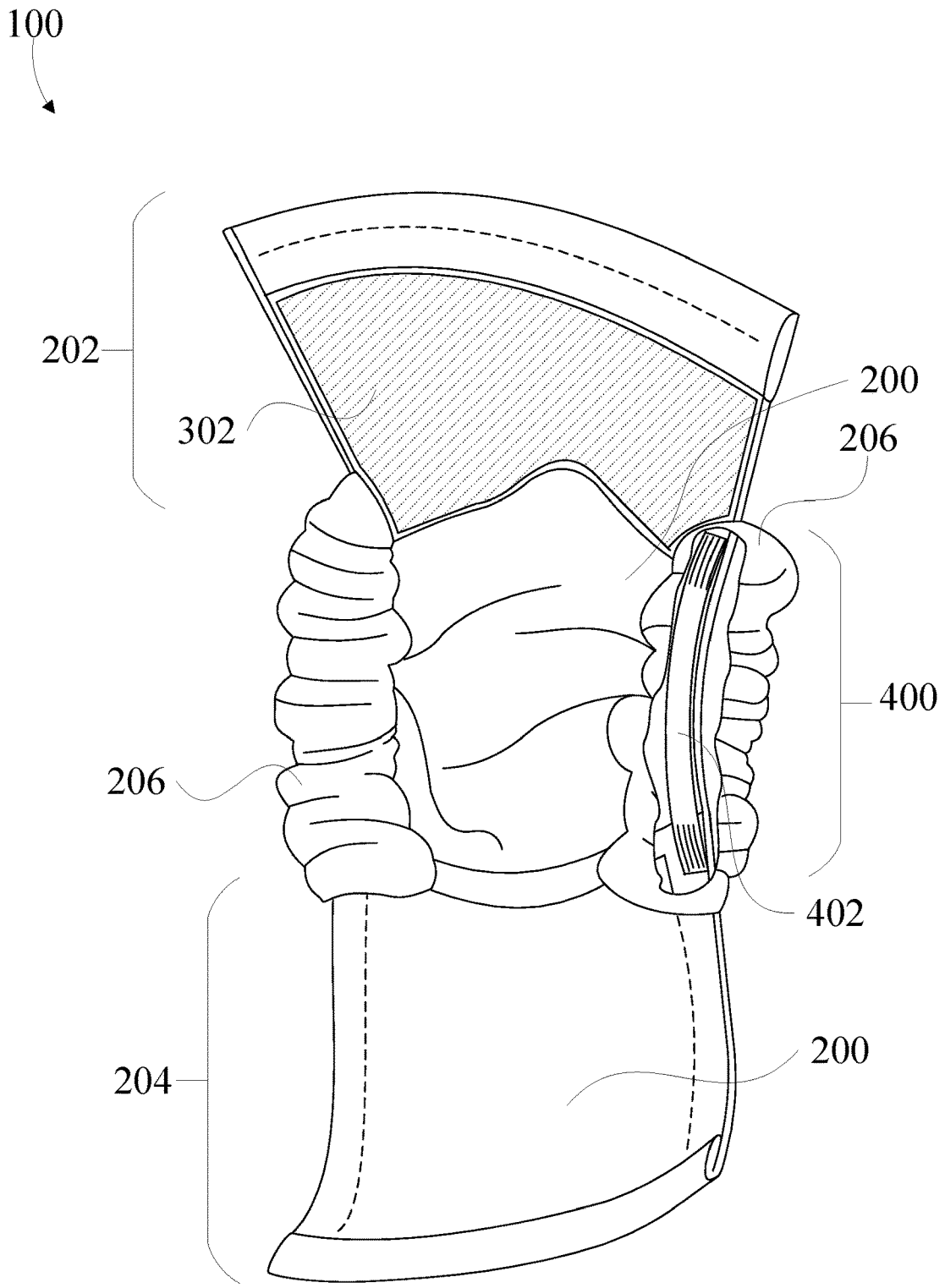
FIG. 4 is a cutaway view illustrating one embodiment of a knot holder.

FIG. 4 depicts a cutaway view illustrating one embodiment of a knot holder.

Figure 13:
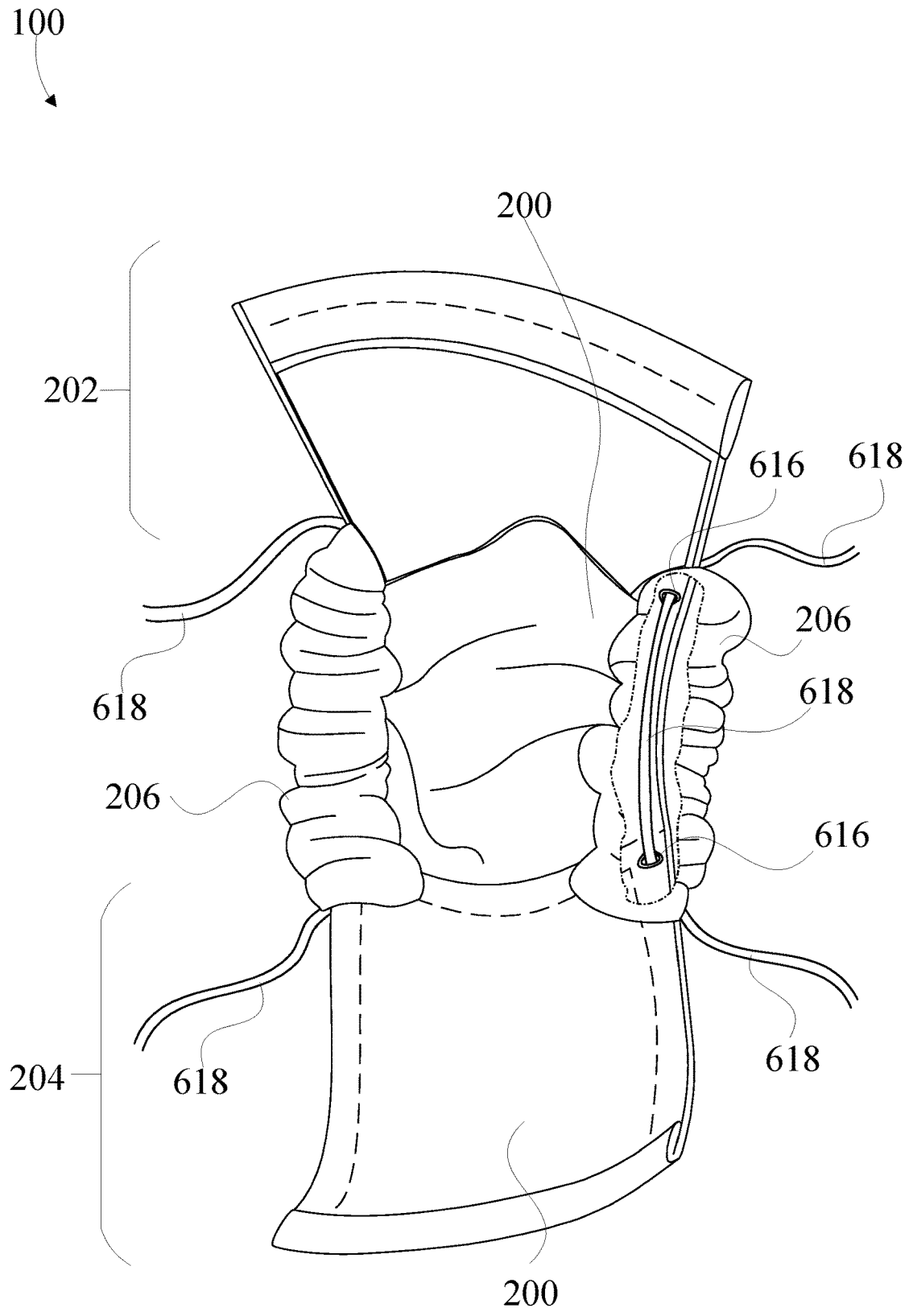
FIG. 13 is a back perspective view illustrating one embodiment of a knot holder.

In some embodiments, the apparatus 100 includes a tightening mechanism 400 that increases the effectiveness of the apparatus 100 by applying more force against the knot to keep it tied. The additional force that is applied also helps to maintain the apparatus 100 in position and keep the apparatus from slipping off of the knot. The tightening apparatus 400 may comprise a variety of different mechanisms, such as strips made of various materials, such as elastic, rubber, rubber bands, or other materials with similar properties. Other embodiments may utilize other mechanisms, some of which are used as examples herein. For example, the tightening mechanism 400 may comprise a plurality of holes 616 in the retention surface 102 and a cord 618 weaved through the plurality of holes in the retention surface, as shown in FIG. 13. The embodiments are not limited to the specific examples provided herein.

In some embodiments, and as shown in FIG. 4, the tightening mechanism 400 may comprise one or more elastic strips 402 coupled to the first end 202 of the retention surface 102 and the second end 204 of the retention surface 102. The elastic strip 402 is sized such that it is under tension while the apparatus 100 is around a knot or in an open position, which pulls the first end 202 of the retention surface 102 towards the second end 204 of the retention surface 102, tightening the entire apparatus 100 against the knot.

In some embodiments, the tightening mechanism 400 automatically applies its additional force without any action from the user, because of the nature of the materials used or by another mechanism. For example, as described above, some embodiments comprise an elastic strip 402 that automatically applies the additional force because of the size of the elastic strip 402 and the position at which it is coupled to the first end 202 of the retention surface 102 and the second end 204 of the retention surface 102. However, in other embodiments, the tightening mechanism 400 may require the user to manually apply the additional force to the tightening mechanism 400. In such embodiments, the tightening mechanism 400 may additionally comprise a tightening lock. Once the tightening mechanism 400 has provided additional force on the retention surface 102 to secure the apparatus 100 against the knot, the tightening lock may lock the tightening mechanism 400 in place, such that the force applied by the tightening mechanism 400 is maintained after the user initially tightens the tightening mechanism 400.

In some embodiments, the tightening mechanism 400 is placed inside or behind the gusset 206, hiding the tightening mechanism 400 from view. More importantly, however, in such embodiments the gusset 206 acts as a guide for the tightening mechanism 400, and prevents interference with the operation of the tightening mechanism 400 by the user, other portions of the apparatus 100, the knot, the material from which the knot is made, or other possible sources of interference. For example, if elastic strips 402 are used, then the elastic strips 402 would run inside the gussets 206 and the gussets would run between the points where the elastic strip 402 is coupled to the first end 202 of the retention surface 102 and the second end 204 of the retention surface 102. Similarly, if a drawstring is used, each drawstring would run inside a gusset 206, and the gusset 206 would be attached at each point where the drawstring passes through the first end 202 of the retention surface 102 and the second end 204 of the retention surface 102.

Figure 5:
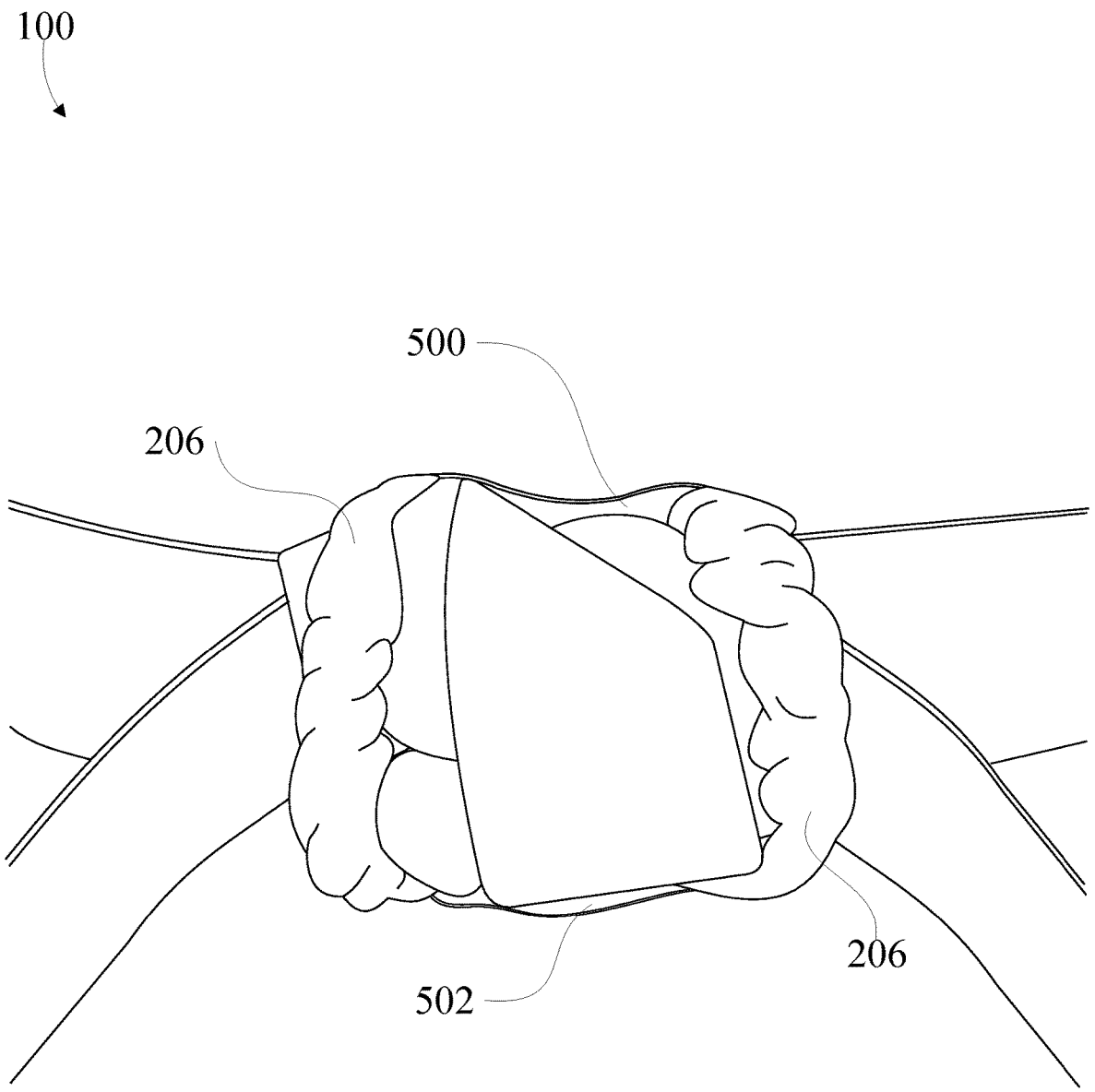
FIG. 5 is a front perspective view illustrating one embodiment of a knot holder that exposes the knot.
Figure 6:
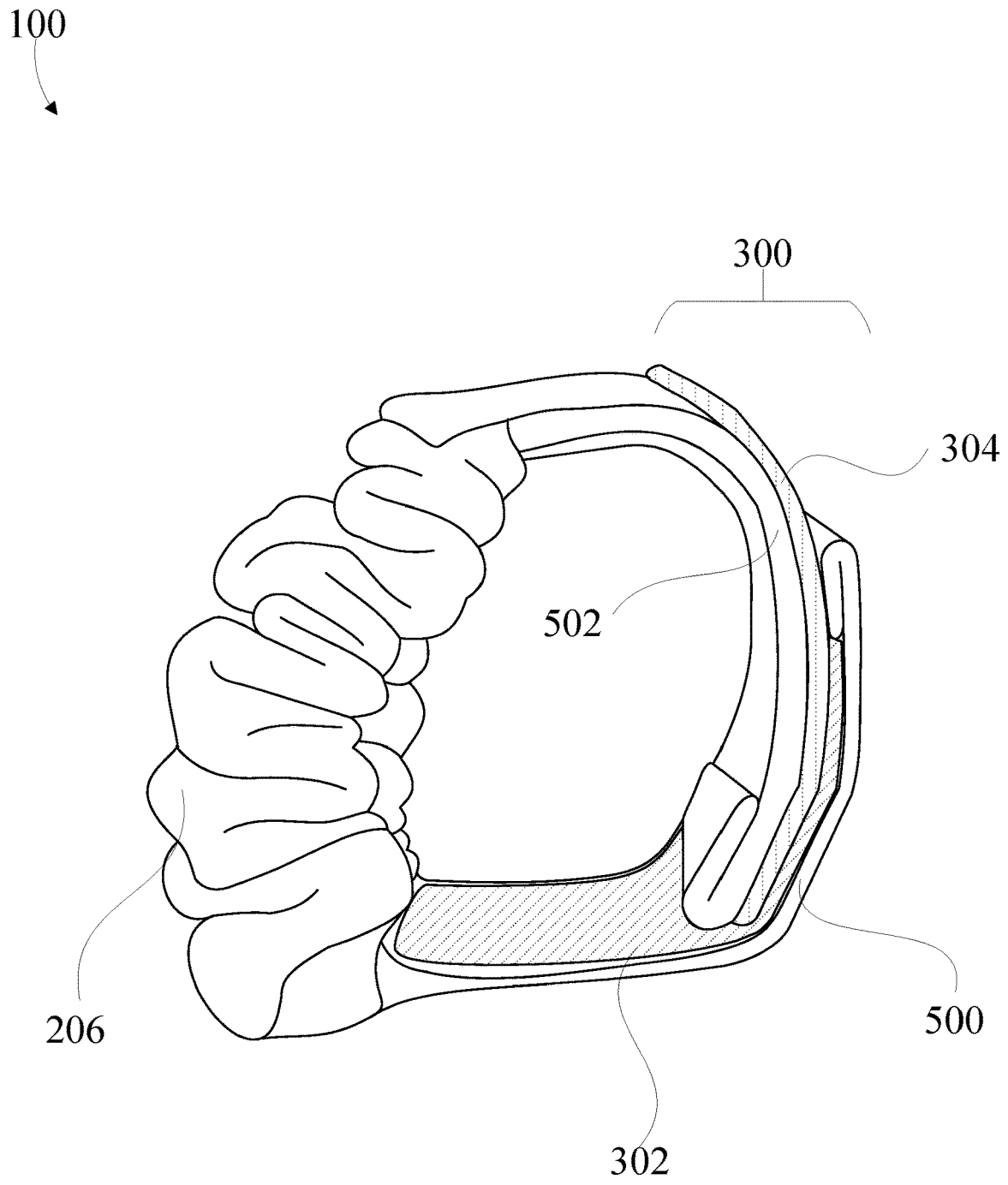
FIG. 6 is a side perspective view of the embodiment of FIG. 5.
Figure 7:
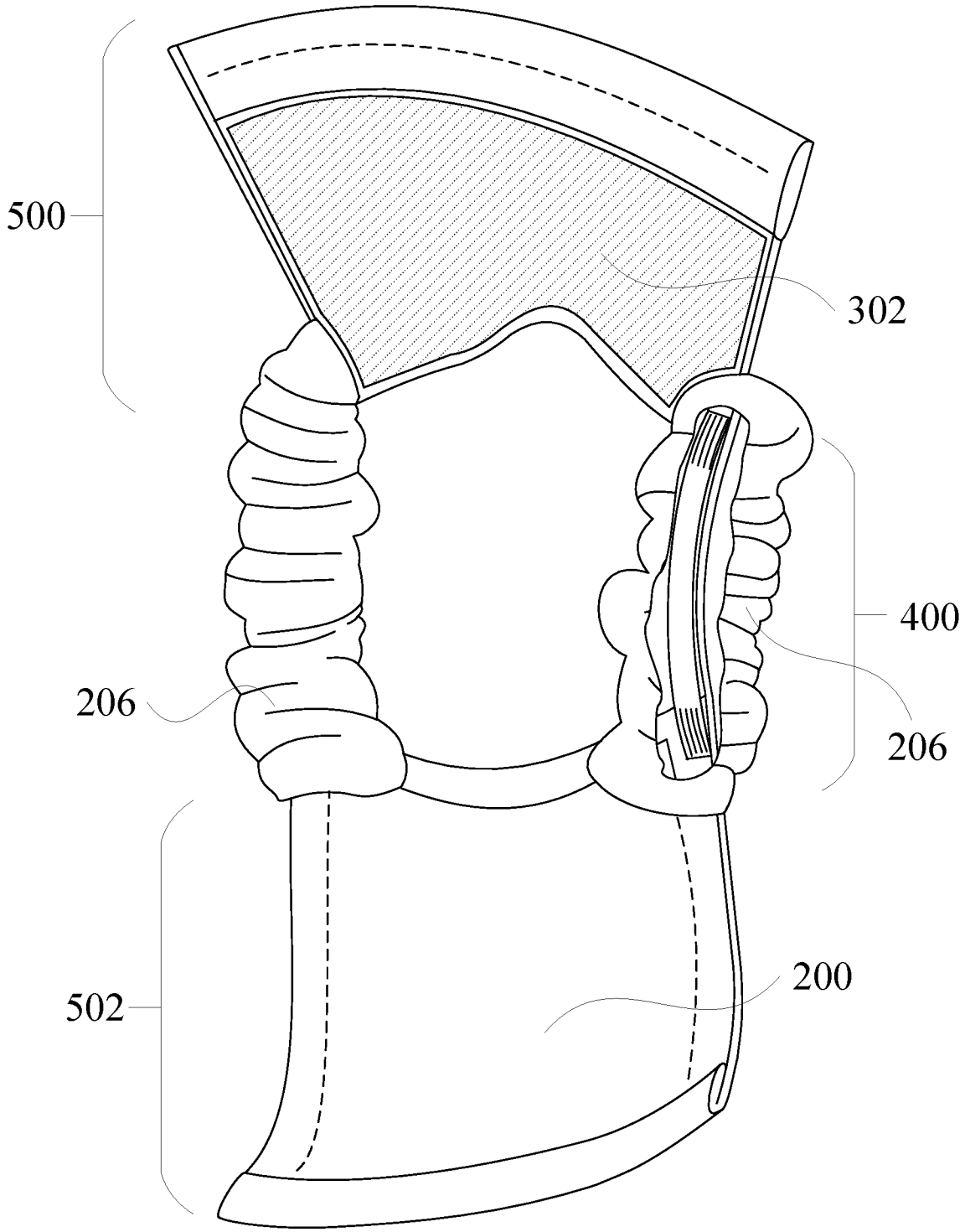
FIG. 7 is a back perspective and cutaway view of the embodiment of FIG. 5.

FIG. 5 depicts a front perspective view illustrating one embodiment of a knot holder that exposes the knot, FIG. 6 depicts a side perspective view of the embodiment of FIG. 5, and FIG. 7 depicts a back perspective view of the embodiment of FIG. 5.

In some embodiments, the apparatus 100 exposes the knot that is being held by the apparatus 100. In martial arts, for example, some users may wish to maintain a more traditional appearance to the knot tied in martial arts belts (perhaps in tournaments or in other situations where a more traditional appearance is desired or where logos, words, pictures or other markings on the apparatus 100 would be distracting or unpleasant), while still offering a high level of retention for the knot.

In some such embodiments, the apparatus 100 comprises a first retention surface 500 and a second retention surface 502. In some embodiments, the first retention surface 500 and the second retention surface 502 are permanently coupled to one another with a gusset 206, a tightening mechanism 400, a connection member or other structure. Other embodiments may use any combination of a gusset 206, a tightening mechanism 400, a connection member and other structures. Such coupling, whether by one or multiple structures, is distinct from the coupling of the first retention surface 500 and the second retention surface 502 that is provided by the retention mechanism 300.

In some embodiments that expose the knot, the function of the tightening mechanism 400, gussets 206, retention mechanism 300 and tapered or narrowed first retention surface 500 and second retention surface 502 is similar to other example embodiments provided herein that discuss the tightening mechanism 400, gussets 206, retention mechanism 300, and tapered or narrowed first end 202 and second end 204 of the retention surface 102. However, the embodiments are not limited to those specific examples, and may include additional uses that fall within the scope of this disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:
- a retention surface that substantially surrounds a knot;
- a retention mechanism that couples a first end of the retention surface to a second end of the retention surface, and
- a tightening mechanism that tightens the retention surface against the knot.

2. The apparatus of claim 1, wherein the retention surface comprises a stretchable material.

3. The apparatus of claim 2, wherein the stretchable material comprises an elastane material.

4. The apparatus of claim 1, wherein the tightening mechanism comprises at least one elastic strip coupled to the first end of the retention surface and the second end of the retention surface.

5. The apparatus of claim 1, wherein the tightening mechanism comprises
- a plurality of holes in the retention surface; and
- a cord weaved through the plurality of holes in the retention surface.

6. The apparatus of claim 1, wherein the retention mechanism comprises:
- a hook surface coupled to the first end of the retention surface; and
- a loop surface coupled to the second end of the retention surface.

7. The apparatus of claim 1, wherein the retention mechanism comprises:
- a snap stud coupled to the first end of the retention surface; and
- a snap socket coupled to the second end of the retention surface.

8. The apparatus of claim 1, wherein the retention mechanism comprises:
- at least one hole in the first end of the retention surface;
- at least one hole in the second end of the retention surface; and
- a cord weaved through the at least one hole in the first end of the retention surface and the at least one hole in the second end of the retention surface.

9. The apparatus of claim 1, wherein the retention mechanism comprises:
- a button coupled to the first end of the retention surface;
- a hole coupled to the second end of the retention surface that receives the button.

10. The apparatus of claim 1, wherein the retention mechanism comprises:
- a zipper, comprising
  - a first zipper tape coupled to the first end of the retention surface, and
  - a second zipper tape coupled to the second end of the retention surface.

11. The apparatus of claim 1, wherein the retention mechanism comprises:
- at least one hook coupled to the first end of the retention surface; and
- at least one eye coupled to the second end of the retention surface.

12. The apparatus of claim 1, wherein:
- the first end of the retention surface is tapered; and
- the second end of the retention surface is tapered.

13. The apparatus of claim 1, further comprising a plurality of gussets coupled to edges of the retention surface.

14. An apparatus, comprising
- a first retention surface;
- a second retention surface;
- a retention mechanism that couples the first retention surface to the second retention surface; and
- a tightening mechanism that tightens the first retention surface and the second retention surface against a knot.

15. The apparatus of claim 14, wherein the apparatus further comprises at least one gusset coupled to the first retention surface and the second retention surface.

16. The apparatus of claim 14, wherein the tightening mechanism comprises at least one elastic strip coupled to the first retention surface and the second retention surface.

17. The apparatus of claim 14, wherein the retention mechanism comprises:
- a hook surface coupled to the first retention surface; and
- a loop surface coupled to the second retention surface.

18. The apparatus of claim 14, wherein
- the first retention surface is tapered; and
- the second retention surface is tapered.

19. A method, comprising:
- providing a knot holder that comprises:
  - a retention surface,
  - a retention mechanism that fastens a first end of the retention surface to a second end of the retention surface, and
  - a tightening mechanism that tightens the retention surface against a knot;
- placing the knot holder around the knot;
- fastening the first end of the retention surface to the second end of the retention surface with retention mechanism of the knot holder; and tightening the knot holder against the knot with the tightening mechanism of the knot holder.

* * * * *